US005090453A

United States Patent [19]

Stacher et al.

[11] Patent Number: 5,090,453

[45] Date of Patent: Feb. 25, 1992

[54] TORSION BAR TYPE WARP TENSIONING DEVICE FOR A LOOM

[75] Inventors: Angelo Stacher, Arbon; Rudolf Vogel, Grut, both of Switzerland

[73] Assignee: Sulzer Brothers Limited, Winterthur, Switzerland

[21] Appl. No.: 510,937

[22] Filed: Apr. 19, 1990

[30] Foreign Application Priority Data

May 2, 1989 [CH] Switzerland ..... 01670/89

[51] Int. Cl.[5] ..... D03D 49/12

[52] U.S. Cl. ..... 139/115

[58] Field of Search ..... 139/110, 114, 115, 98; 242/75.5

[56] References Cited

U.S. PATENT DOCUMENTS

| | | | |
|---|---|---|---|
| 4,240,471 | 12/1980 | Rotrekl et al. | 139/114 |
| 4,534,386 | 8/1985 | Pfarrwaller | 139/114 |
| 4,546,801 | 10/1985 | Bucher et al. | 139/110 |

FOREIGN PATENT DOCUMENTS

| | | |
|---|---|---|
| 0109472 | 5/1984 | European Pat. Off. . |
| 0136389 | 4/1985 | European Pat. Off. . |
| 2910528 | 11/1979 | Fed. Rep. of Germany . |
| 63-67575 | 12/1988 | Japan . |
| 0661754 | 8/1987 | Switzerland . |
| 0667294 | 9/1988 | Switzerland . |

*Primary Examiner*—Andrew M. Falik
*Attorney, Agent, or Firm*—Kenyon & Kenyon

[57] ABSTRACT

A tensioning device of a loom is embodied by a tensioning element rotatably mounted on a plurality of rollers which, in turn, are supported at spaced apart bearing places on a drive shaft. The drive shaft is biased by a torsion bar acted on its end by an adjusting mechanism driven by means of an eccentric. The tensioning device comprises a reduced number of parts of reduced dimension and can therefore adapt very rapidly to changes in the position of the warp yarns. The tensioning device is particularly suitable for high-speed looms which process delicate warp yarns.

9 Claims, 5 Drawing Sheets

TORSION BAR TYPE WARP TENSIONING DEVICE FOR A LOOM

This invention relates to a tensioning device for a loom.

Heretofore, various types tensioning devices have been known for use in looms. For example, Japanese Patent Publication 63-67575 describes a tensioning device in which a tensioned whip roll is mounted to extend across the width of a loom so as to deflect warp yarns extending from a warp beam to a shed produced within the loom by a shedding mechanism. In this case, the whip roll is mounted in pivotable bearing brackets and a tension spring acts at one end on a prolongation of each bracket and, at the other end, acts on the end of a lever which is pivotally mounted in the loom frame and which has a thrust rod articulated to the other end. A bearing bracket is secured on this lever near its fulcrum. The thrust rod can be reciprocated by a crank drive at the cadence of the loom so that the lever is moved in a substantially translational motion. The spring end mounted on the lever end is also moved substantially in translation, the movements of the bearing bracket and of the securing position of the spring being oppositely directed to one another. The combined motions of the lever and bearing bracket are intended to move the warp towards the shedding elements during shedding and to reduce warp tension.

The structure described in the Japanese publication shows that the tensioning element, which is a roller, is secured to at least two bearing brackets which are in turn disposed on at least two levers in each case with two springs. A crank of the crank drive engages one lever end. However, a practical construction of the diagrammatically illustrated structure would have a large number of individual components not capable of being moved at high frequency since there is an excessive number of high-inertia parts between the drive shaft and the warp yarns. Consequently, the system would be likely to suffer from uncontrollable vibrations, particularly in an embodiment for a heavy cloth for relatively high speeds which in the case of air jet looms can be up to 1000 revolutions per minute. The vibrations would be responsible for severe stress variations in the warp yarns, possibly leading to warp yarn breakages and reducing loom profitability.

Accordingly, it is an object of the invention to provide a low-stress driven tensioning device for the warp of a loom.

It is another object Of the invention to provide a tensioning device for a loom which is suited to heavy fabric and which has a sensitive response to tension variations in the warp and to changes of position in the drive of the system.

It is another object of the invention to provide a warp tensioning device which can be operated at a high speed of a loom.

It is another object of the invention to eliminate vibrations in a Warp tensioning device of a loom.

Briefly, the invention provides a tensioning device for a loom which includes a drive shaft disposed for pivoting about a pivot axis, a torsion bar disposed coaxially within the drive shaft and which is connected at one end to the shaft and an adjusting mechanism connected to an opposite end of the torsion bar for adjusting the biasing of the bar at the cadence of a loom cycle. In addition, a warp tension element is disposed on a second axis parallel to the pivot axis of the drive shaft and is mounted on the drive shaft via a plurality of mounting means secured to the drive shaft in spaced apart relation for rotation therewith. In addition, each mounting means has the tensioning element rotatably mounted thereon for rotation about the axis of the tensioning element.

In addition to the tensioning element for tensioning and deflecting the warp yarns, a deflecting element is disposed upstream of the tensioning element for deflecting the warp yarns. In this case, the rotational axis of the tensioning element, the pivot axis of the drive shaft and the axis of the deflecting element define the vertices of an equilateral triangle. The Warp yarns are deflected by the deflecting element and tensioning element through substantially the same angle from a substantially Vertical direction into a horizontal direction. The bisector of the angle which is formed, on the one hand, by the Warp yarns present between the deflecting element and the tensioning element and, On the other hand, by the warp yarns leaving the tensioning element (i.e. the angle formed by the warp yarns passing over the tensioning element) is spaced from the pivot axis of the drive shaft. The perpendicular distance between the bisector and the pivot axis can be very reduced, for example, 10% of the distance between the tensioning element axis and the drive shaft pivot axis.

The tensioning device can have a sensor for detecting a signal which is a criterion of the relationship between warp yarn consumption in the loom and warp yarn make-up from the warp beam. This signal is transmitted to a controller (control unit) for the device. In an advantageous embodiment of the device, a warp beam drive motor to unwind the warp beam is connected to the controller. The sensor can be, for example a force sensor for recording the amount of thrust being transmitted in the thrust rod of the adjusting mechanism. Thus, upon receiving a signal corresponding to the amount of thrust being transmitted , the controller may selectively generate a responsive signal for emission to the drive motor of the warp beam for changing the speed of the motor.

The drive shaft of the tensioning device is constructed so as to be carried in at least two bearings inside a loom frame. In addition, each mounting means for the tensioning element is provided with a pair of rotatably mounted rollers for rotatably mounting the tensioning element thereon.

Due to the great sensitivity, which is the result of the reduced Weight, and the low-friction mounting of the tensioning element, the tensioning device can operate at a point at which the tensioning element is in a position in which the resulting force of the warp yarns just passes by the tensioning element pivot axis. The torque in the drive shaft for the tensioning device therefore remains very reduced and so only a weak torsion bar (spring) is needed to bias the drive shaft. The forces and stresses in the tensioning device therefore stay very low, and so the components thereof can be lightly dimensioned and can therefore operate at high working frequencies.

These and other objects and advantages of the invention will become more apparent from the following detailed description taken in conjunction with the accompanying drawings wherein:

FIG. 1 diagrammatically illustrates a plan view of a loom constructed in accordance with the invention;

Figure 1:
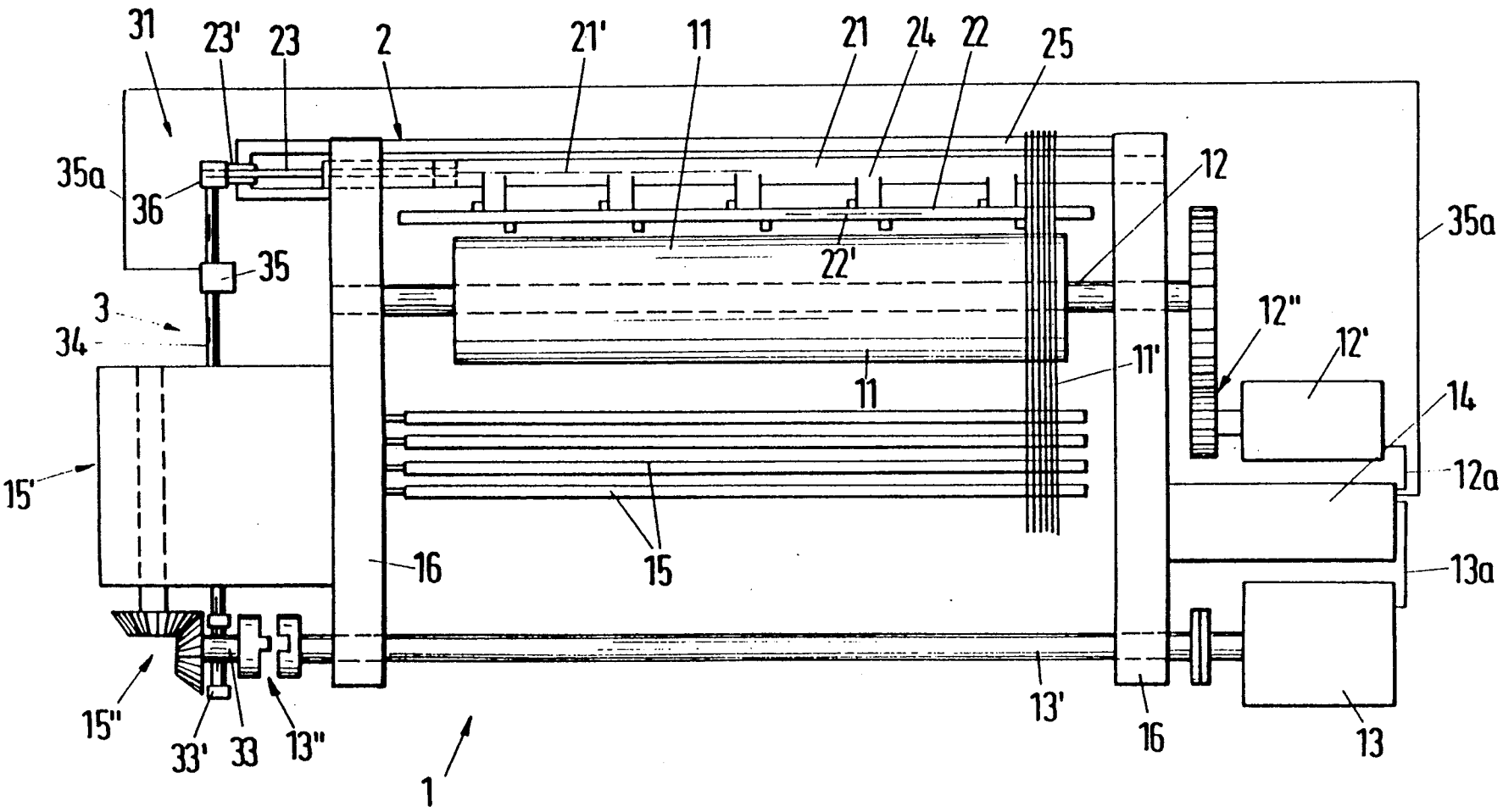

Referring to FIG. 1, the loom 1 comprises, at the bottom, a main driving motor 13 adapted to be coupled with a main shaft 13'. By way of a clutch 13", a shedding motion unit 15' can be coupled with the main shaft 13'. A pair of bevel gears 15" transmits the driving power to shafts 15 connected to the shedding motion unit 15'. An eccentric 33' is disposed on a drive shaft 33 adapted to be Coupled with the main drive shaft 13' and drives a thrust rod 34 of an adjusting mechanism 3 for a tensioning device 2.

Warp yarns 11' being processed in the loom are wound on a warp beam 12 as warp 11 and are unwound from the beam 12 by means of a driving motor 12' to which the beam 12 is connected by way of a pair of gears 12". The warp yarns 11' move through the shafts 15 and are alternately raised and lowered thereby.

The tensioning device 2, which comprises a deflecting element 25 and a tensioning element 22, is effective to keep the warp yarns 11' tensioned when the same are deflected to varying extents by the shafts.

Figure 2:
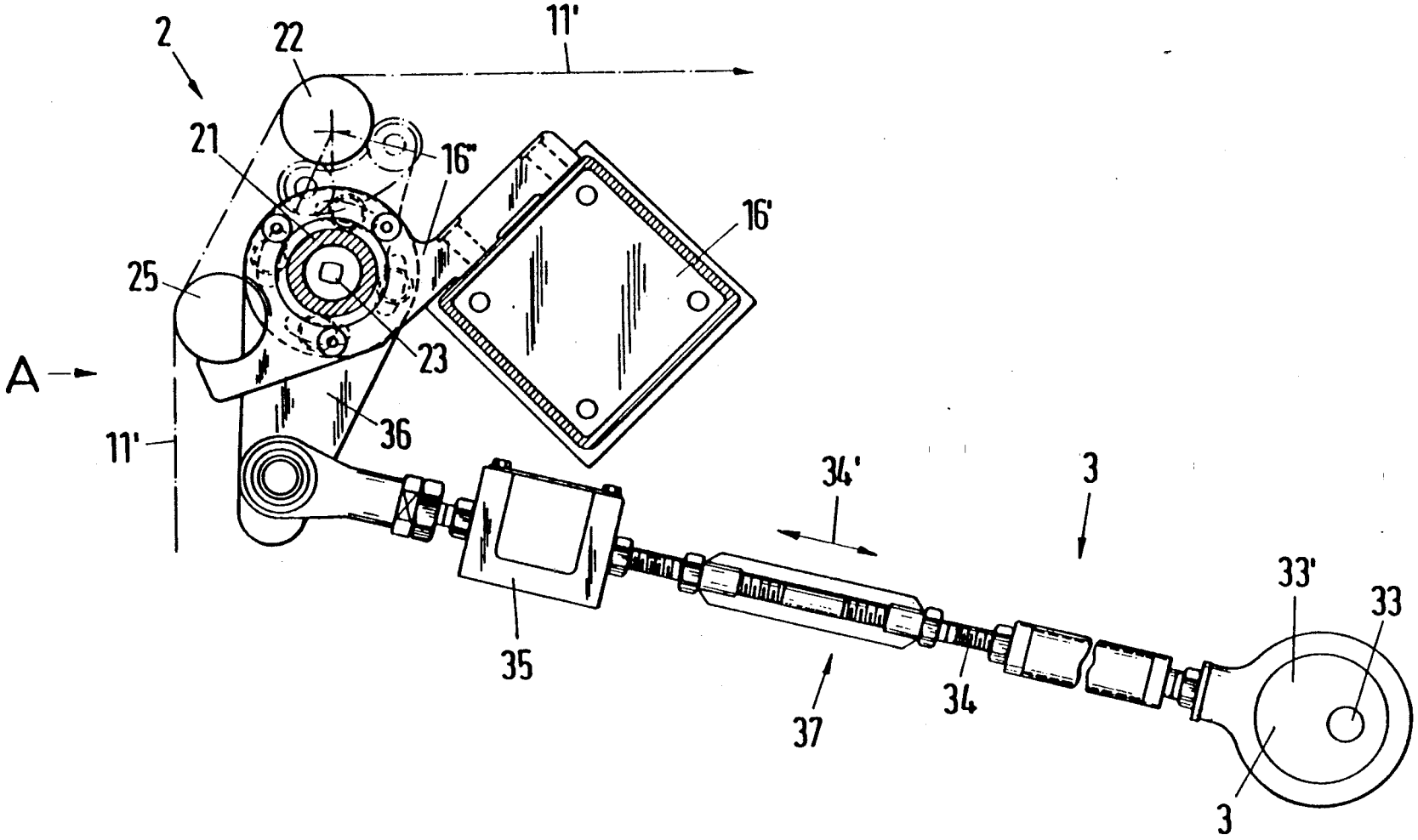
FIG. 2 illustrates a detailed view of a tensioning device according to the invention lengthwise to the loom.
Figure 3:
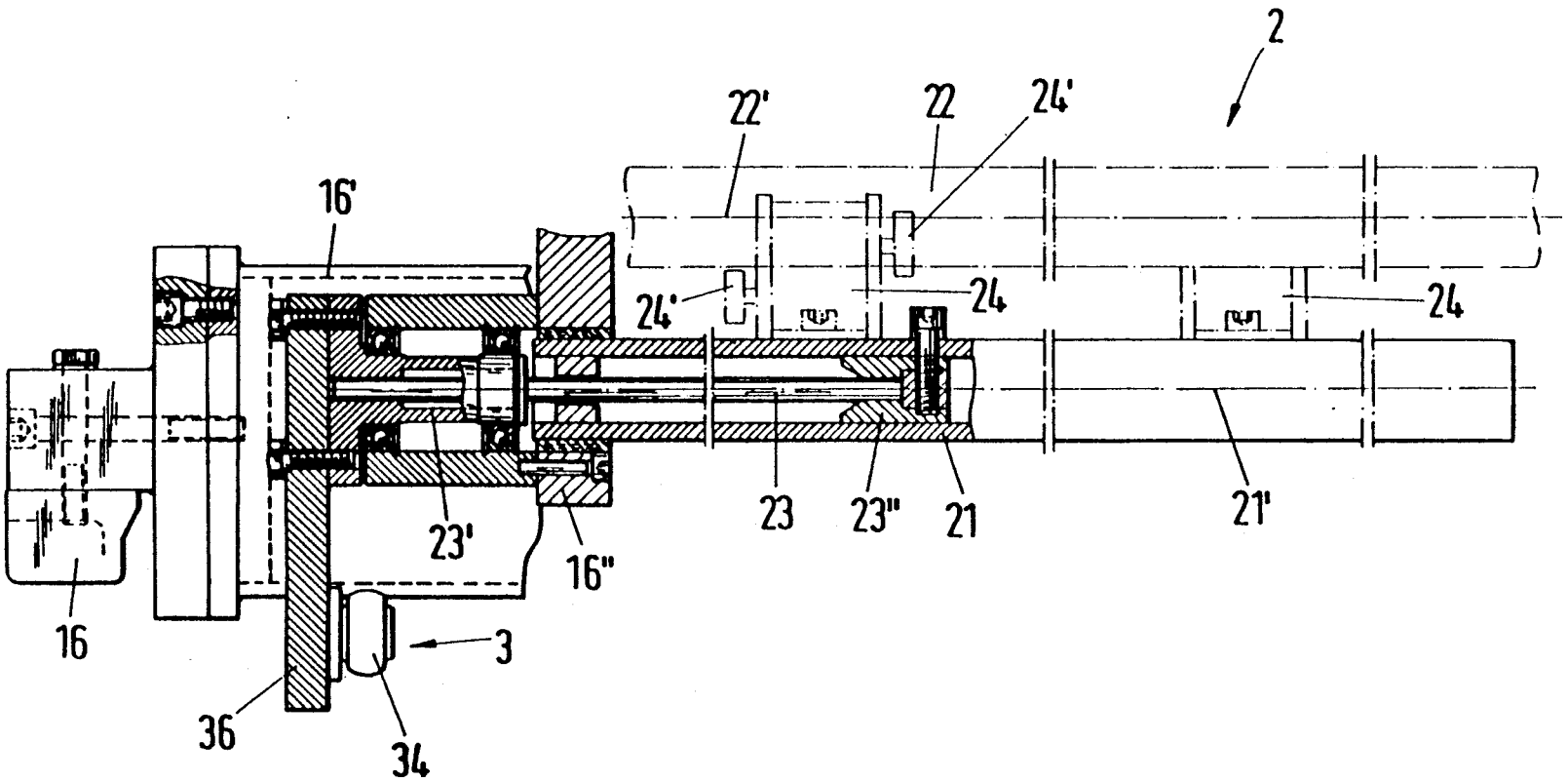
FIG. 3 illustrates a detailed view of the tensioning elements with the warp yarn in a view looking in the direction of an arrow A of FIG. 2.

Referring to FIGS. 2 and 3, the tensioning device 2 includes a drive shaft 21 disposed for pivoting about a pivot axis 21' and which is journalled at each end in a carrier 16" which, in turn, is screwed to a cross-member 16' of the loom. The cross-member 16' is , in turn, secured to and between two uprights 16 of the loom frame. In addition, the tensioning device 2 includes a torsion bar 23 disposed coaxially within the drive shaft 21 on the pivot axis 21'. As illustrated, the torsion bar 23 is connected at one end to the shaft 23 for rotation therewith by means of an entraining member 23" and bolts. At the other end, the torsion bar 23 is secured within a hub 23' which, in turn, is carried by rolling bearings in the cross member 16'.

Figure 4:
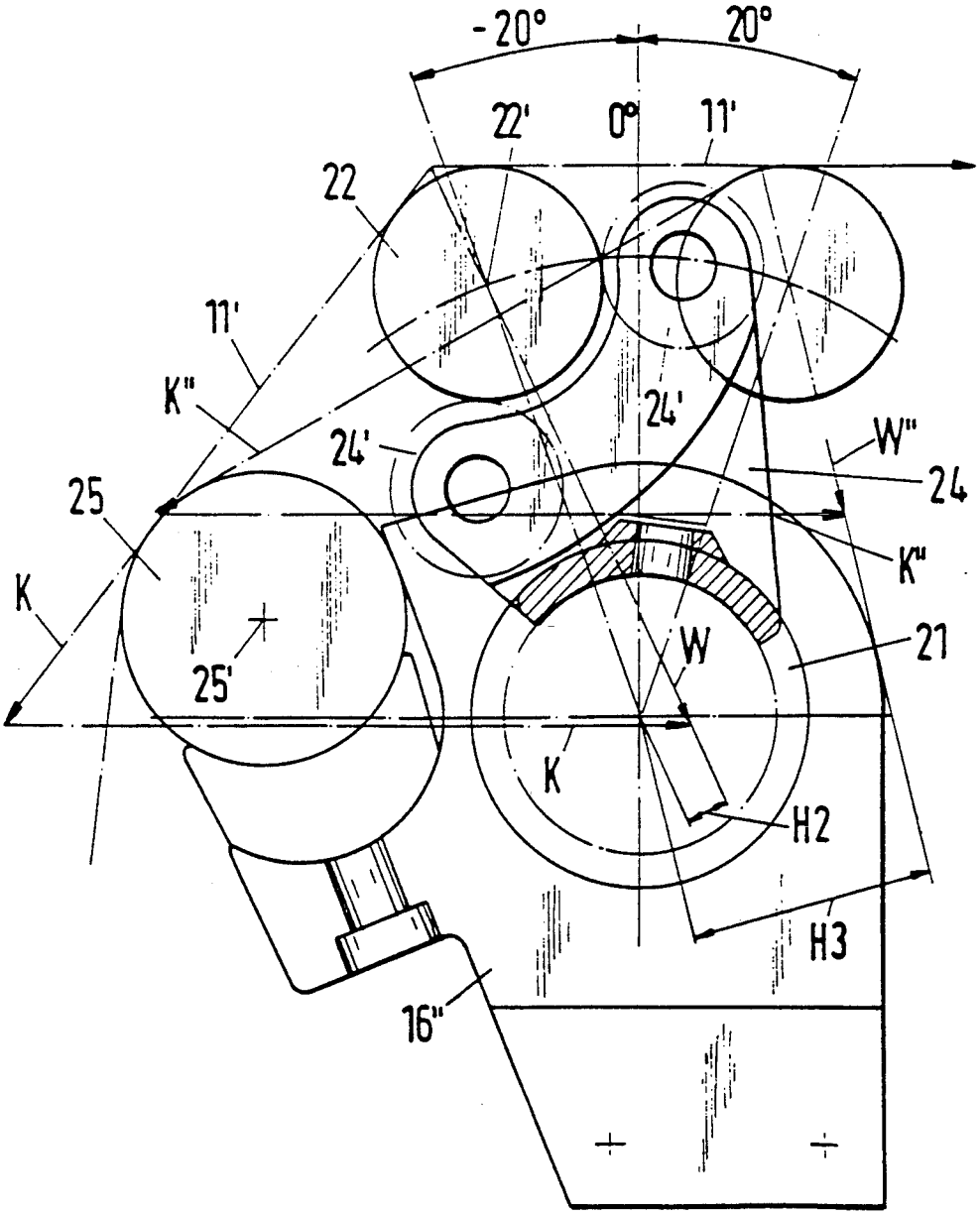
FIG. 4 shows details of the device as in FIG. 2.

The tensioning element 22 of the tensioning device 2 is disposed on an axis 22' parallel to the pivot axis 21' of the drive shaft 21. In addition, a plurality of mounting means 24 are secured to the drive shaft 21 in spaced apart relation for rotation therewith and each has the tensioning element 22 rotatably mounted thereon for rotation about the axis 22'. As illustrated in FIG. 4, each mounting means 24 is rigidly secured to the drive shaft 21 and includes a pair of rotatably mounted rollers 24' for rotatably mounting the tensioning element 22 on the axis 22'.

Referring to FIGS. 2 and 3, the adjusting mechanism 3 includes a rotatable drive shaft 33, an eccentric 33' which is mounted on the drive shaft 33 for rotation therewith, a thrust rod 34 which receives the eccentric 33' at one end and a lever 36 which is secured to and between the thrust rod 34 and the hub 23' in which the torsion bar 23 is secured. As indicated in FIG. 2, the thrust rod 34 has a thrust sensor 35 therein for sensing the amount of thrust transmitted through the rod 34. As indicated, the rod 34 is substantially reciprocated in the direction indicated by the double arrow 34'. In addition, a length adjuster 37 is disposed in the rod 3 and is used to make the basic adjustment of the tensioning device 2.

Referring to FIG. 1, a control line 35*a* extends from the sensor 35 to a controller (control unit) 14 so as to convey a signal corresponding to the amount of thrust being transmitted by the rod 34. The control unit 14 which is responsible for the control functions, for example, of the motor 13 by way of a control line 13*a* or of the motor 12' by way of a control line 12*a* is responsive to the signals received from the sensor 35. For example, when the force measured by the sensor 35 increases beyond a limit value, a corresponding signal is emitted to the controller 14 and the controller generates a responsive signal for emission to the drive motor 12' for increasing the speed of the motor 12'.

Referring to FIG. 2, the tensioning device 2 also includes a deflecting element 25 which is mounted on the carriers 16" on an axis parallel to the axis of the tensioning element 22 for deflecting the warp yarns 11' thereover.

Referring to FIG. 2, the warp yarns 11' move vertically upwardly from a warp beam (not shown) and are deflected by the deflecting element 25 and tensioning element 22 into a horizontal plane. The tensioning element 22 which is pivotable with the torsion bar 23 provides length compensation in the warp yarns when the shafts 15 (see FIG. 1) draw the warp yarns into different positions when forming a shed.

FIG. 4 shows parts of the tensioning device 2 to a larger scale than in FIG. 2. The stationary deflecting element 25 deflects the warp yarns 11' from a substantially vertical position towards the tensioning element 22 which is borne by a number of rollers 24' distributed over the cloth width. Because of the multiple mounting of the element 22 on the rollers 24', the element 22 can be relatively thin. The rollers 24' ensure that the element 22 is readily rotatable around its own axis. Also, the unit embodied by the tensioning element 22 mounting means 24 and drive shaft 23 can perform rapid pivoting movements since the moment of mass inertia of such a unit is reduced as compared with the device previously mentioned according to the Japanese publication.

Figure 5:
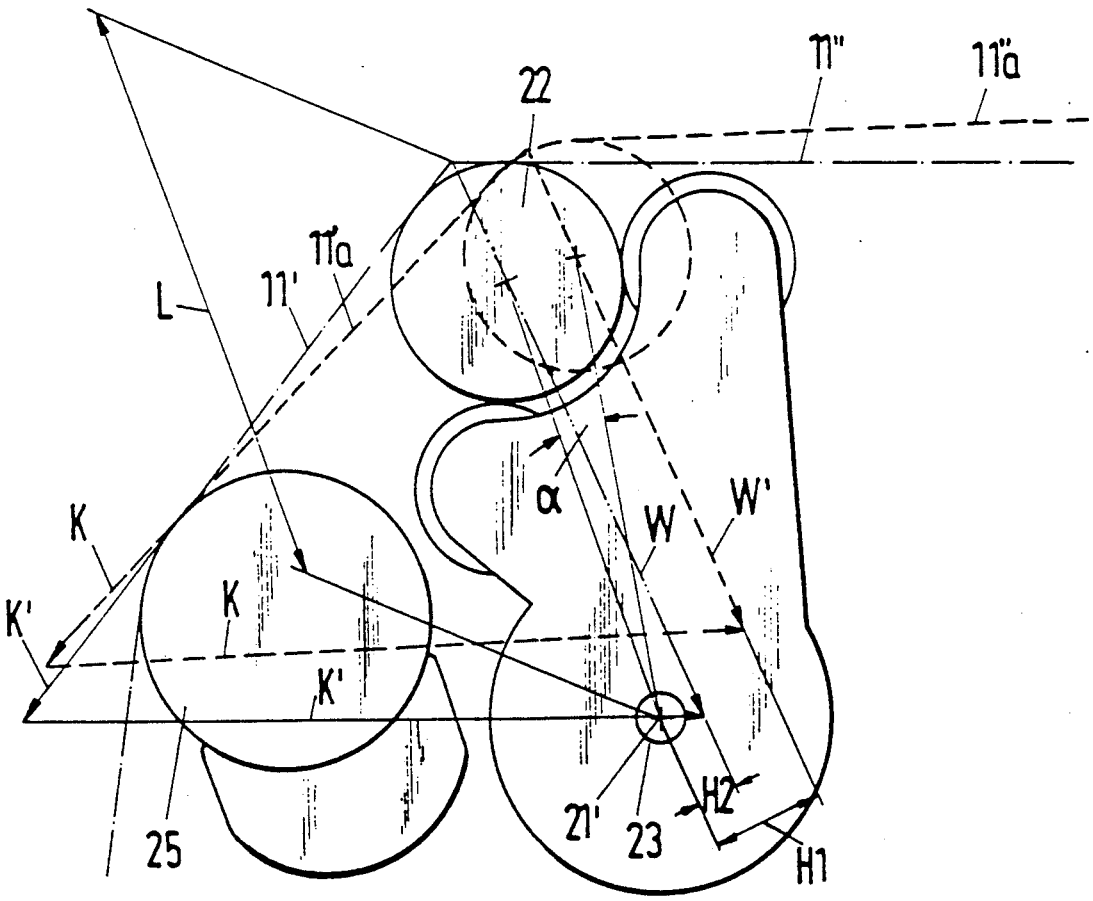
FIG. 5 illustrates a diagrammatic view showing two operative positions of the tensioning device and the force relationships associated with warp yarn tensioning.

When the warp yarns 11' move lengthwise because of the movements of the shafts 15 and thus produce compensating movements of the tensioning device 2, the unit embodied by the tensioning element 22, mounting means 24 and drive shaft 23 can follow the lengthwise movement of the warp yarns very rapidly, movement-transmitting relationships being such that the tensioning element 22 rotates on the rollers 24' around its own axis 22'. The rollers 24' can have a running surface of plastics, for example, Vulkollan, with the advantage that deposits from the possibly dusty air of the warp shed are moved off the contact surfaces by the resilient deformation of the rollers 24' in contact with the tensioning element 22. The operation of the tensioning device 2 will be discussed hereinafter with reference to FIG. 5.

When the warp yarns 11" move during shedding into an intermediate position 11"*a*, the tensioning element 22 moves, for example, from the solid-line position into the chain-line position. The resulting force W, W' exerted by the warp yarns 11' and 11*a* respectively is effective along the angle bisector of the set of lines formed by the warp paths 11', 11" and 11'*a*, 11"*a* respectively. The resultant forces W, W' respectively arising from vectoral addition of the warp yarn forces K, K' respectively, pass by the drive shaft pivot axis 21' at respective distances H2, H1 therefrom as line-transient vectors. When the values of the respective forces W, W' are measured from the associated line sets of the warp yarns as far as their apex in any unit, the following values are found:

$$W=80;\ W'=69$$

Multiplied by the distances H1 and H2, the torques resulting from the forces are as follows:

$$M1=H1\times W'=15\times 69=1035$$

$$M2=H2\times W=6\times 80=480$$

The values are dimensionless and their aim is to indicate the tendency when the element 22 changes position. Consequently, when the tensioning element 22 moves from the solid-line position into the chain-line position in accordance with the positions of the warp yarns 11'' and 11''a, respectively, the torque produced by warp yarn tensions approximately doubles as referred to the axis 21'. The pivot angle of the tensioning element 22 has the reference $\alpha$ in FIG. 5 and a value of 9°. the dimensions of the spring or torsion bar 23—i.e., its length and diameter—should be such that the torque increase in the additional rotation through an angle $\alpha$ in the rod 23 also increases from 480 to 1035. The biasing of the torsion bar 23 should be such that the torque produced by such biasing in the solid-line position of the element 22 also reaches 480. On these assumptions, warp yarn tension would be constant when the warp yarns change from position 11'' to position 11''a. Without the tensioning device 2 the effective pivoting angle of the tensioning element 22 would exceed the angle $\alpha=9°$. and it would therefore be impossible to provide compensation in all the positions of the tensioning element 22 for the torque variation due to the altered position of the warp yarn forces by means of the corresponding altered twist of the torsion bar 23. This is where the adjusting mechanism 3 starts to have an effect because the torsion bar end in the hub 23' in the loom is pivoted reciprocatingly in a harmonic vibration because of the rotation of the eccentric 33' on the drive shaft 33. This harmonic vibration is in synchronism with the vertical reciprocating of the shafts 15 which also produce a substantially harmonic oscillation of the tensioning element around the axis 21' because of the displacement of the warp yarns 11'.

When the angle $\alpha$ is substantially equal to the twist angle of the machine end of the torsion bar 23 as a result of the movement of the adjusting mechanism 3, the twist of the bar 23 remains substantially constant so that the twist of the bar 23 does not cause any great variation in the torque in the tensioning device 2.

When the pivot angle of the lever 36 produced by the adjusting mechanism 3, the biasing of the bar (spring) 23 and the geometry in the tensioning device 2, i.e, the relative position of the tensioning element 2, axis 21' and deflecting element 25 to one another, are chosen satisfactorily, the tension in the warp yarns 11', 11'' and 11'a, 11''a can be kept substantially constant even when the tensioning device 2 moves through a relatively large pivot angle $\alpha$ which, due to increased shaft lifts, is necessary in response to relatively long movements and changes in position of the warp yarns 11'' and 11''a.

Due to the ease with which the relatively thin tensioning element 22 can be rotated on a number of rollers 24' in the mounting means 24, the geometry of the complete tensioning device 2 can be such that the resultant force W of the warp yarns when the element 22 is in its solid-line position passes by the pivot axis 21' at a reduced distance therefrom. The resulting torque is therefore comparatively small and so that rod 23, lever 36 and the complete adjustment mechanism 3 can be of reduced dimensions. If the tensioning element 22 could be rotated around its own axis either with difficulty or not at all, the warp yarns 11' would, because of their relative movement on the surface of the element 22, produce, in response to a change in tensioning element position, friction forces and therefore a friction torque which would be relatively large as compared with the force-induced torque. The additional friction moment would destroy the balance between the torque due to Warp yarn tension and the opposing torque produced by biasing of the torsion bar 23, with detrimental effects on warp yarn tensions.

Therefore, the tensioninq device 2 can be operated in geometric conditions when the resultant force W misses the pivot axis 23 by only a small amount. If the distance L between the axis 21' of the drive shaft 21 and the place where the warp yarns 11' are deflected on the tensioning element 22, i.e. the point of intersection of the two tangents representative of the planes of the warp yarns passing onto and from the tensioning element 22, a ratio L/H2 in a range of from 10 to 15 can be defined in which the tensioning device 2 can provide undisturbed operation. The ration L/H2 must be much smaller in the known prior art tensioning devices if these devices are to operate far enough away from the risk of jamming when H2=0. Consequently, it is important that the biasing of the tensioning element 22 be produced by mens of a low-weight torsion bar 23 and that the tensioning element 22 itself be mounted on a number of rollers 24' and therefore be of reduced dimensions. Only in this way can it be ensured that the tensioning device 2 reacts sensitively to displacements of the warp yarns 11'' and 11''a, tension variations in the warp yarns which are induced by the self-dynamics of the tensioning device 2 remaining negligible. Weaving corresponding to particular technical textile assumptions therefore calls for much less tensioning of the Warp yarns as compared with the prior art tensioning devices and variations in tension, i.e. the difference between tension peaks and troughs, remain relatively low. The warp is therefore stressed less, and so there are less disturbances in weaving, for example, due to warp yarn breakages.

The invention thus provides a tensioning device for warp yarns which is capable of reliable operation in a high speed weaving machine.

The invention further provides a tensioning device for the warp yarns in a loom which is capable of operating with reduced vibration.

The invention further provides a tensioning device which is particularly suitable for high speed looms which process delicate process yarns.

What is claimed is:

1. A tensioning device for a loom comprising a drive shaft disposed for pivoting about a pivot axis;

a torsion bar disposed coaxially within said drive shaft on said pivot axis, said bar being connected to said shaft;

an adjusting mechanism connected to said torsion bar for adjusting the biasing of said bar at the cadence of a loom cycle;

a warp tensioning element disposed on a second axis parallel to said pivot axis of said drive shaft; and a plurality of mounting means secured to said drive shaft in spaced apart relation for rotation therewith and having said tensioning element rotatably mounted thereon for rotation about said second axis.

2. A tensioning device as set forth in claim 1 wherein said adjusting mechanism includes a second rotatable drive shaft, an eccentric mounted on said second drive shaft for rotation therewith, a lever secured at one end to said torsion bar and a thrust rod secured to and between said eccentric and a second end of said lever.

3. A tensioning device as set forth in claim 2 which further comprises a thrust sensor in said thrust rod for sensing the amount of thrust transmitted therethrough.

4. A tensioning device as set forth in claim 3 which further comprises a controller operatively connected to said thrust sensor for receiving a signal corresponding to the amount of thrust being transmitted therein and for selectively generating a responsive signal for emission to a drive motor of a warp beam for changing the speed of the motor.

5. A tensioning device as set forth in claim 1 wherein each mounting means is rigidly secured to said drive shaft and includes a pair of rotatably mounted rollers rotatably mounting said tensioning element thereon.

6. A tensioning device as set forth in claim 5 wherein each roller is made of plastic.

7. In a loom, the combination of a deflecting element disposed on a first axis for deflecting a plurality of warp yarns thereover;

a tensioning element disposed on a second axis parallel to said first axis and downstream of said deflecting element for deflecting the warp yarns thereover;

a drive shaft disposed for pivoting about a pivot axis parallel to said first axis;

a torsion bar disposed coaxially within said drive shaft on said pivot axis, said bar being connected to said shaft;

an adjusting mechanism connected to said torsion bar for adjusting the biasing of said bar at the cadence of a loom cycle; and a plurality of mounting means secured to said drive shaft in spaced apart relation for rotation therewith and having said tensioning element rotatably mounted thereon for rotation about said second axis.

8. The combination as set forth in claim 7 wherein said first axis, said second axis and said pivot axis define vertices of an equilateral triangle.

9. The combination as set forth in claim 8 wherein said deflecting element and said tensioning element are disposed to equally deflect the warp yarns over a predetermined angle from a vertical plane into a horizontal plane and wherein a bisector of said angle defined by the warp yarns over said tensioning element is spaced from said pivot axis of said drive shaft at a perpendicular distance equal to 1/10 to 1/15 of the distance between said pivot axis and said second axis.

* * * * *

UNITED STATES PATENT AND TRADEMARK OFFICE

CERTIFICATE OF CORRECTION

PATENT NO. : 5,090,453

DATED : February 25, 1992

INVENTOR(S) : Stacher et al.

It is certified that error appears in the above-identified patent and that said Letters Patent is hereby corrected as shown below:

Column 1, line 7, change "types tensioning" to --types of tensioning-- line 51, change "Of" to --of-- line 60, change "Warp" to --warp--

Column 2, line 3, change "spaced" to --spaced- -- line 14, change "Warp" to --warp-- line 16, change "Verti-" to --verti- -- line 19, change "Warp" to --warp-- line 20, change "On" to --on-- line 21, change "i.e." to --i.e.,--

UNITED STATES PATENT AND TRADEMARK OFFICE

CERTIFICATE OF CORRECTION

PATENT NO. : 5,090,453

DATED : February 25, 1992

INVENTOR(S) : Stacher et al.

It is certified that error appears in the above-identified patent and that said Letters Patent is hereby corrected as shown below:

Column 2, line 36, change "for example" to --for example,-- line 40, change "transmitted ," to --transmitted,-- line 51, change "Weight" to --weight--

Column 3, line 18, change "Coupled" to --coupled-- line 48 and 49, change "spaced apart" to --spaced-apart-- line 67, change "rod 3" to --rod 34--

Column 5, line 22, change "the" to --The-- line 33, change "9°. and" to --9°, and--

UNITED STATES PATENT AND TRADEMARK OFFICE

CERTIFICATE OF CORRECTION

PATENT NO. : 5,090,453

DATED : February 25, 1992

INVENTOR(S) : Stacher et al.

It is certified that error appears in the above-identified patent and that said Letters Patent is hereby corrected as shown below:

Column 6, line 3, change "small and so that" to --small so that the-- line 14, change "Warp" to --warp-- line 27, change "The ration L/H2" to --The ratio L/H2-- line 32, change "by mens" to --by means-- line 42, change "Warp yarns" to --warp yarns-- line 44, change "troughs, remain" to --troughs remains-- line 57, change "process delicate process yarns" to --process delicate warp yarns--

UNITED STATES PATENT AND TRADEMARK OFFICE

CERTIFICATE OF CORRECTION

PATENT NO. : 5,090,453

DATED : February 25, 1992

INVENTOR(S) : Stacher et al.

It is certified that error appears in the above-identified patent and that said Letters Patent is hereby corrected as shown below:

Column 7, line 2, change "spaced apart relation" to --spaced-apart relation--

Column 8, line 14, change "spaced apart" to --spaced-apart--

Signed and Sealed this

Ninth Day of November, 1993

Bruce Lehman

*Attest:*

BRUCE LEHMAN

*Attesting Officer*

*Commissioner of Patents and Trademarks*